United States Patent [19]

Smet

[11] Patent Number: 4,921,057

[45] Date of Patent: May 1, 1990

[54] METHOD AND DEVICE FOR MAKING A HOLE IN THE GROUND

[76] Inventor: Nic H. W. Smet, Kasteelstraat 29, B - 2400 Mol, Belgium

[21] Appl. No.: 345,300

[22] Filed: May 1, 1989

Related U.S. Application Data

[62] Division of Ser. No. 83,191, Aug. 10, 1987, Pat. No. 4,850,440.

[30] Foreign Application Priority Data

Aug. 13, 1986 [BE] Belgium ..... 2/61030

[51] Int. Cl.[5] ..... E21B 7/18

[52] U.S. Cl. ..... 175/203; 175/67; 405/232

[58] Field of Search ..... 175/1, 67, 203, 402, 175/394, 322, 424, 15, 22, 25, 38; 405/232, 233, 303, 248, 184

[56] References Cited

U.S. PATENT DOCUMENTS

| | | | |
|---|---|---|---|
| 3,804,182 | 4/1974 | Adair et al. | 175/67 X |
| 4,047,580 | 9/1977 | Yahiro et al. | 175/424 X |
| 4,074,779 | 2/1978 | Cheung et al. | 175/67 X |
| 4,534,427 | 8/1985 | Wang et al. | 175/424 X |
| 4,714,118 | 12/1987 | Baker et al. | 175/67 X |

*Primary Examiner*—Dennis L. Taylor

*Attorney, Agent, or Firm*—Stevens, Davis, Miller & Mosher

[57] ABSTRACT

The head is carried by two flexible continuous drill pipes which surround each other and which are flexible enought to be uncoiled from a reel but which are still rigid enough almost not to get twisted in the ground on themselves or relative to each other during the operation of the head. The head is directed in the ground by means of fluid wich is pumped through one of the pipes and wherewith the head is repelled relative to the wall of the already formed portion of the hole. One of the pipes connects to one or more directable spray nozzles on the front end of the head, the other one connects to one or more sidewise-issueing openings wherein preferably a directable spray nozzle is mounted.

6 Claims, 4 Drawing Sheets

METHOD AND DEVICE FOR MAKING A HOLE IN THE GROUND

This is a division of application Ser. No. 083,191 filed August 10, 1987, now U.S. Pat. No. 4,850,440.

BACKGROUND OF THE INVENTION

The invention relates to a method for making a hole in the ground, according to which one brings at least two lines in the ground which connect with one end thereof to one and the same head, lines from which one communicates with at least one spray opening which opens on that end lying forward in the direction of the hole to be made, of the head, outside said head, and the other one communicates with at least one sidewise-lying opening in the head, whereby the head is driven into the ground notably by pumping fluid under a first high pressure through that line which opens on the opening in the forward-lying head end, and pumping at least temporarily fluid under another second pressure through the other line.

The head itself may be provided with a cutting tool and possibly with a fluid-operated motor to drive said cutting tool.

Such a method is known from FR-A-2,493,907.

According to said known method, one discharges through a first line, the nature of which is not further described and which communicates with spray nozzles on the head front end, fluid under a very high pressure from 500 to 4000 bars to make the hole in the ground. Through a second line lying adjacent thereto, the nature of which is not further described either, fluid under a lower pressure is pumped through a turbine mounted in the head and through openings in the head side, along the outer head side towards the frontmost end. Said fluid is used on the one hand to drive the turbine, and on the other hand to flush the hole clean and thus to remove the waste. The turbine is used to impart a rotating movement to the rotatable head end.

The head is directed in the ground by means of a guide which is mounted on the head and which comprises three units which are arranged about the head. By means of hydraulic jacks, which are operated with fluid which is fed through a third line, the guide is displaced stepwise in the hole together with the head, while by means of other hydraulic jacks, some direction can be given to the guide relative to the already-bored hole and thus some direction can be given to the head and consequently to the direction of the hole still to be drilled.

Due to the requirement of having to use a guide and to feed fluid through three lines, said method is relatively costly. As the guide has to be moved stepwise, the method is not simple. Further the directing is very difficult to perform accurately. The hydraulic jacks for the directing bear during such directing on the wall of the already-formed hole. Such jacks can thereby enter into the hole wall when such wall is not very strong, which makes accurate directing impossible.

The invention has for object to obviate such drawbacks and to provide a method for making a hole in the ground which is inexpensive, simple and fast and still makes possible directing accurately the head and consequently determining accurately the hole direction.

THE INVENTION

For this purpose, use is made for the lines, of somewhat flexible continuous drill pipes which are flexible enough to be coiled on a reel and uncoiled therefrom, but which are still rigid enough almost not to get twisted in the ground, on themselves or relative to one another, during the head operation, and the head is being directed in the ground by means of fluid which is pumped through at least one of these pipes and wherewith the head is repelled relative to the wall the required direction.

Due to the head being directed with fluid which is pumped through the one line, an additional directing device is superfluous.

Such directing by means of fluid through a line is only possible because the head is mounted on the somewhat flexible but still rigid enough drill pipes, whereby the head position and consequently the direction of the spray nozzles in the ground may be accurately determined. Due to the drill pipes still being flexible and consequently continuous, fluid under high pressure can be driven therethrough and there are no fluid leaks, as this is actually the case for example when use is made of rigid drill pipes which are comprised of lengths to be coupled together.

Because the lines can be coiled on or uncoiled from a reel, the bringing of the line in the hole and thereafter the removing therefrom may occur quite fast. No pipe lengths have to be uncoupled from one another.

As the drill pipes are still relatively rigid and for example are not flexible rubber hoses, the change of direction of the drilling head is accompanied by the lines flexing. Once the head has taken some specific direction, it will also go on following such direction, unless the head direction is changed anew by means of fluid.

Such flexible but still relatively rigid drill pipes are known per se. Such pipes are for example steel pliable drill pipes.

As flexible lines are uncoiled from a reel and thus described a circle shape about the reel, said lines should first be pulled straight before bringing same in the ground, which is for example performed by means of a guide which is arranged above the ground or on top of the hole.

FURTHER BACKGROUND

The use of such a flexible line which is uncoiled from a reel and pulled straight by means of a guide, is known per se from U.S. Pat. No. 3,856,095.

In the method according to this U.S. Patent, use is hovewer made of a single line. With the guide above the ground, the line is pulled straight and directed, but only vertically towards the underground. A change in the head direction in the ground is not possible.

THE INVENTION

According to the invention, the head direction in the ground can be changed in various ways, whereby said head can be mounted as well fixedly as rotatably relative to the lines. Instead of a rotatable head, the frontmost end of the head may simply be rotatable relative to the remainder thereof.

Such directing is obtained by spraying asymmetrically relative to the hole axis, which may be performed in various ways, as well by spraying through the opening in the frontmost end, as by spraying through the sidewise-issueing head opening.

In a first embodiment of the invention, use is made of a head which comprises at least in one spray opening on the frontmost end, a directable spray nozzle and the head is directed by adjusting the direction of said spray nozzle.

The direction of the spray nozzle proper relative to the head may be adjusted when it is adjustable in itself, or the direction thereof may be adjusted by revolving the head itself or a swingable portion thereof whereon the spray nozzle is provided, relative to the head axis when said spray nozzle is mounted out of center relative to said axis or a swingable head portion.

In another embodiment of the invention, use is made of a head which is provided with at least two spray through at least one of said openings is adjustable, and the head is being directed by adjusting the flow rate.

In still another embodiment of the invention, use is made of a head which comprises in at least one sidewise-issueing opening, a directable nozzle, and the head is being directed by adjusting the direction of said nozzle.

In still another embodiment of the invention, use is made of a head which comprises at least two sidewise-issueing openings, whereby the flow rate of at least one of them is adjustable, and the head is directed by adjusting said flow rate.

In still another embodiment, use is made of a head which comprises one or a plurality of sidewise-issueing spray openings lying asymmetrically over the circumference, which are located on a rotatable head or on a portion thereof which is rotatable about the axis thereof, and the head is being directed by revolving the head or the rotatable portion thereof.

Obviously said adjustments of the spray head direction or said adjustment of the flow rates of the spray openings, or still said revolving of the head or a rotatable portion thereof, are remotely controlled from above the ground.

Use may be made therefor of hydraulic or electric motors or valves.

In an advantageous embodiment of the invention, use is made of two flexible pipes, the one of which surrounds the other one, and fluid is pumped under one pressure through the innermost pipe and fluid under the other pressure is pumped through the space between the outermost and innermost pipe.

In a particular embodiment of the invention, the fluid under the first pressure, is pumped under a pressure higher than 100 kg/cm$^2$.

Usefully the fluid under the first pressure, is pumped under a pressure higher than 300 kg/cm$^2$.

In a remarkable embodiment of the invention, the fluid is pumped under the first pressure with a first flow rate which is larger than 10 liters per minute.

The invention further pertains to a device which is particularly suitable for the working of the method according to one of the preceding embodiments.

The invention thus relates to a device for making a hole in the ground, which device comprises a head which is provided with at least one spray opening on the frontmost end thereof and with at least one sidewise-issueing opening, and two lines for first spray opening and said latter opening, and at least one pump which is connected to at least one of said lines, the characteristic of which lies in the device comprising a reel and the lines being continuous flexible drill pipes which are flexible enough to be coiled on and uncoiled from the reel, but which are still rigid enough almost not to get twisted in the ground on themselves, or relative to one another, during the head operation.

In a preferred embodiment of the invention, one flexible pipe surrounds the other one.

In a remarkable embodiment, the device comprises means for straightening the flexible pipes between the reel and the hole in the ground.

In an useful embodiment of the invention, the head comprises adjustable means for adjusting the spraying through the openings assymmetrically relative to the head axis.

Other features and advantages of the invention will stand out from the following description of a method for making a hole in the ground and of a device used thereby according to the invention; this description is only given by way of example and does not limit the invention; the reference numerals pertain the accompanying drawings.

DRAWINGS

Figure 3:
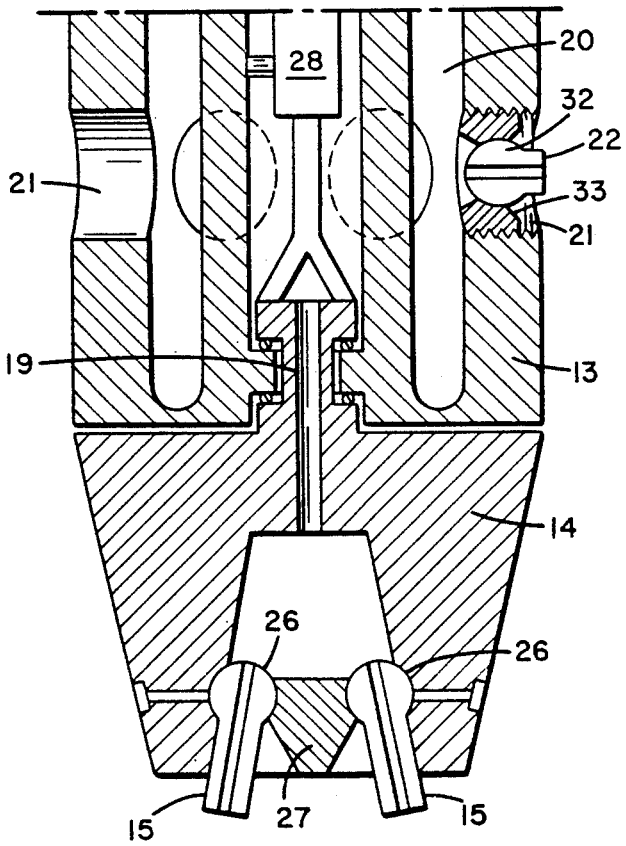
FIG. 3 shows a cross-section of a fist embodiment of a rotatable end of the head from the device as shown in the above figures.
Figure 3A:
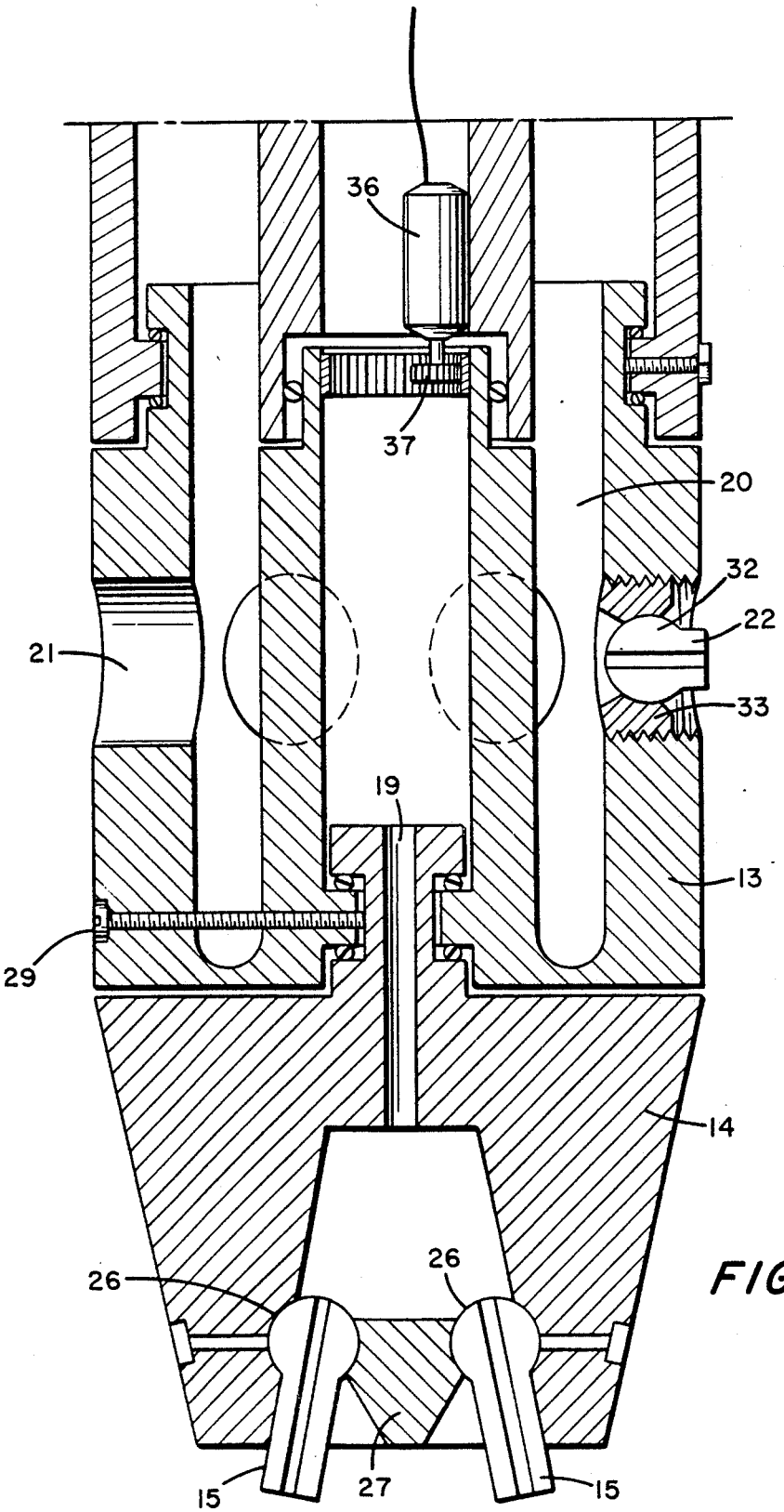

FIG. 3*a* shows a cross-section of a second embodiment of the rotatable end of the head with a rotatable head body.

Figure 3C:
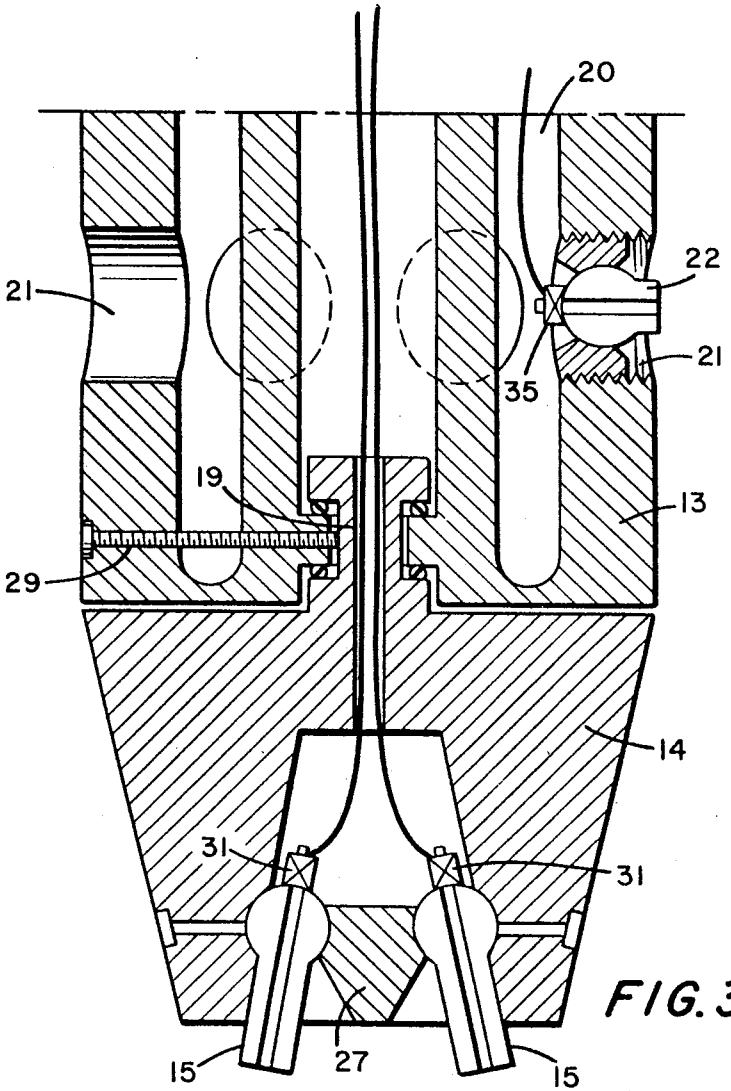
Figure 3B:
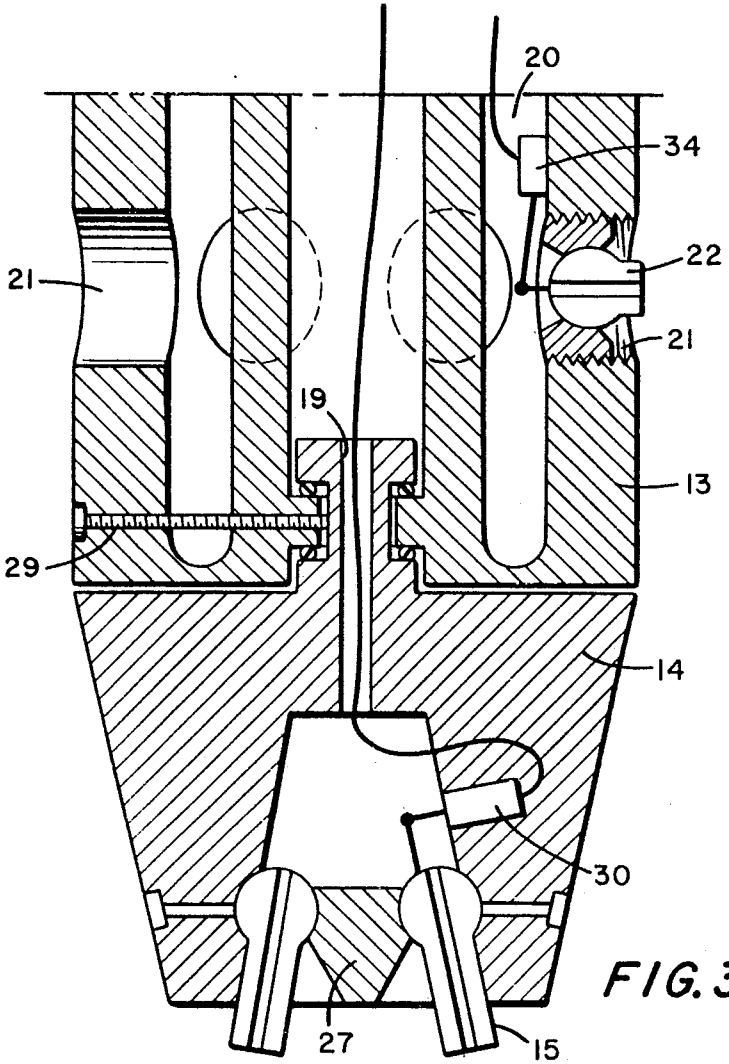

FIG. 3*b* shows a cross-section of a third embodiment of the rotatable end of the head with position adjustable nozzles.

FIG. 3*c* shows a cross-section of a fourth embodiment of the rotatable end of the head with flow adjustable nozzles.

In the figures the same reference numerals pertain to the same elements.

DETAILED DESCRIPTION OF PREFERRED EMBODIMENTS

The device as shown in the figures comprises a reel 1 which is arranged with the axis thereof lying horizontally and supported at both ends thereof by means of bearings 2 in supports 3.

A twin, somewhat flexible but still relatively rigid drill pipe, comprised of an innermost flexible pipe 4 and an outermost flexible pipe 5 surrounding the innermost one, is coiled on the reel 1.

Both pipes 4 and 5 are made from steel and are continuous. Such flexible drill pipes are known per se.

Instead of steel pipes, pipes from another metal or even some synthetic materials may also be used as long as on the one hand they are pliable enough to be wound about a reel, but on the other hand rigid enough to retain, once they have been bent along a direction, said direction during the making of a hole, unless they are changed purposefully and by exerting some force, and mostly to remain stationary in the ground relative to the lengthwise axis thereof and thus approximately not to get twisted on themselves e.g. to revolve round their axis even with relatively strong torsion moments.

The lowermost end of the two flexible pipes 4,5 lying on the core of reel 1, goes through an opening 6 inside the hollow body of reel 1. Inside said body, the innermost pipe 4 leaves the outermost pipe 5. The outermost pipe 5 passes outside the body of reel 1 through one of the bearings 2, while the innermost pipe 4 leaves the body of reel 1 through the other bearing 2.

Exactly outside of reel 1, in each of said separated pipes 4 and 5, a revolving coupling, a so-called "rotary seal" 7 is mounted, in such a way that the end of said pipes 4 and 5 does not revolve when the reel 1 revolves together with the twin pipe 4,5.

Said latter ends from pipes 4 and 5 both connect to a distributing valve 8 which in the one position, brings pipe 4 in communication with line 9, and pipe 5 with a line 10, and in another position, brings pipe 4 in communication with line 10 and pipe 5 in communication with line 9.

Figure 1:
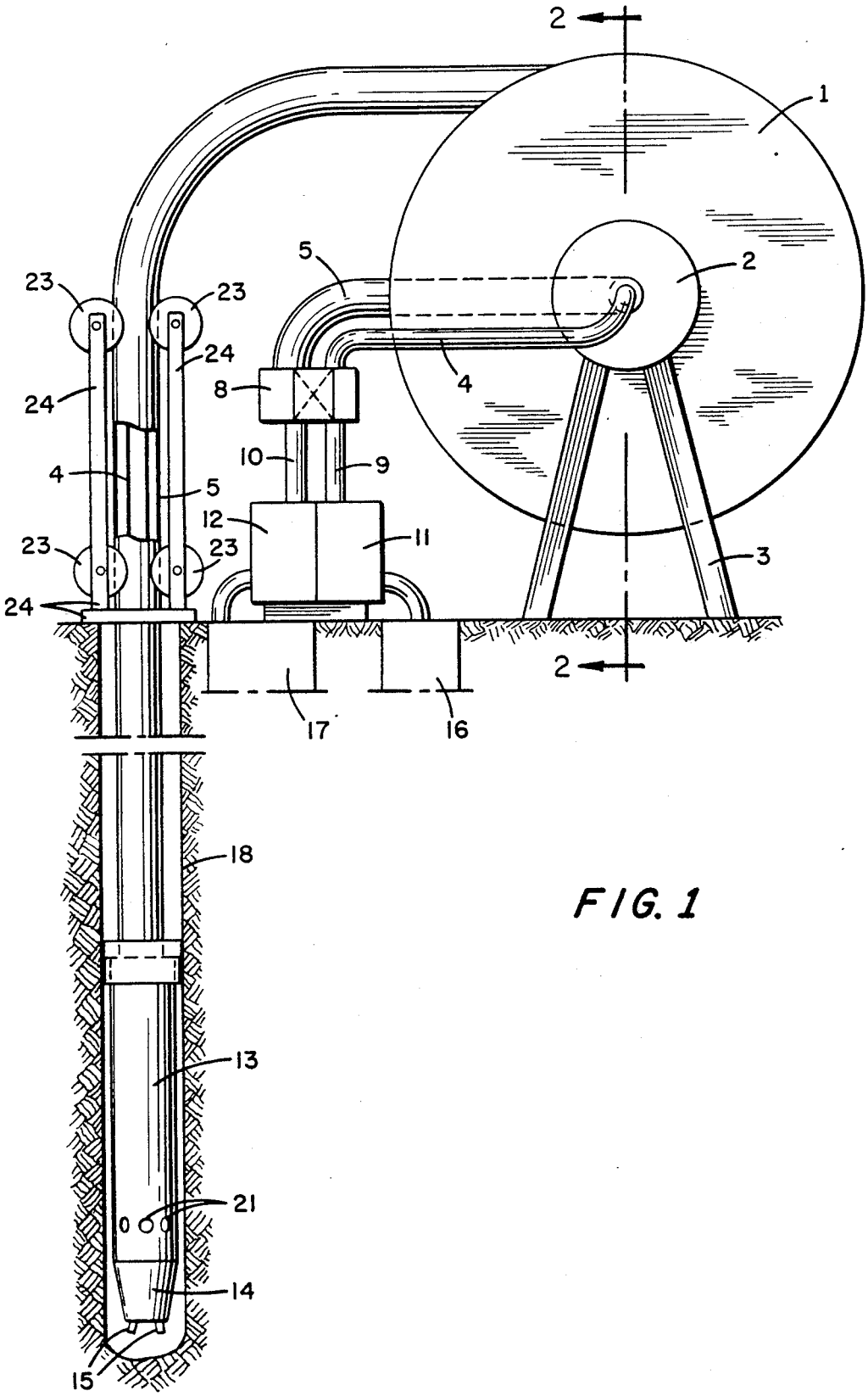
FIG. 1 is a diagrammatic side view partly in section, of a device for making a hole in the ground according to the invention.
Figure 2:
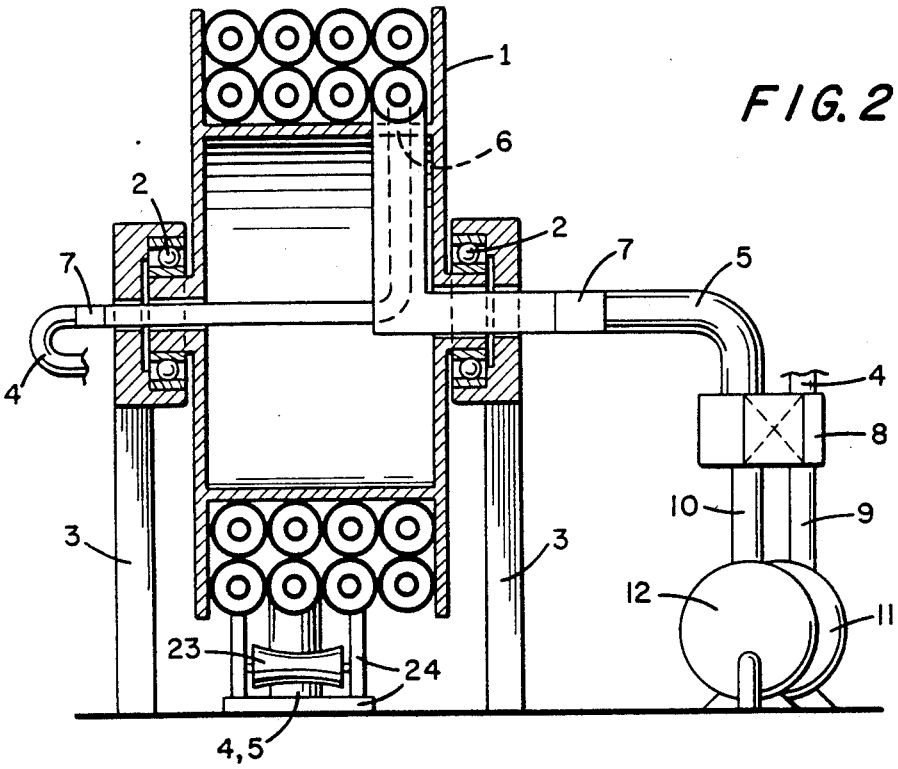
FIG. 2 shows a section along line II—II in FIG. 1.

The line 9 connects to the outlet side of a high-pressure pump 11 the suction side of which is connected to a first fluid tank 16 shown in FIG. 1, and which can pump said fluid with a first pressure higher than 100 kg/cm$^2$, and preferably higher than 300 kg/cm$^2$, and for example between 100 and 2000 kg/cm$^2$ and a first flow rate larger than 10 liters per minute and for example between 100 and 150 liters per minute.

Said fluid may be a liquid such as water, or a gas such as air, or a mixture of liquid and gas such as foam.

The line 10 connects to the outlet side of a second pump 12 the suction side of which connects to a second tank 17 with a carrier fluid. Said carrier fluid may be a liquid such as water or bentonite, or may be a gas such as air. The pump 12 pumps with a lower pressure than pump 11, namely a second pressure lower than 300 kg/cm$^2$, and preferably about 200 kg/cm$^2$, but supplies a second flow rate which is larger than the first flow rate, namely larger than 10 liters per minute and preferably larger than 400 liters per minute.

The other end of the twin flexible pipe 4,5 removably connects to a head 13,14.

Said head 13,14 is comprised of a body 13 and an end 14 rotatably mounted about the lengthwise axis of said body 13, on that end thereof removed from the flexible pipes 4 and 5 surrounding one another.

The rotatable mounting of the end 14 on body 13 can occur in a known way, obvious to the man of the art, and is clearly shown in FIGS. 3, 3*a*, 3*b* and 3*c*.

The rotatable end bears in front two spray nozzles 15 directed outwards, which are adjustable in direction. The nozzles 15 have a ball-shaped end 26 mounted in a bearing 27 of corresponding shape which bearing is formed in the end 14.

The direction of the spray nozzles 15 is so adjusted for drilling that the spray nozzles 15 will cover the whole opening of the hole 18 to be formed.

With said spray nozzles, fluid is sprayed under high pressure whereby the ground is loosened and the head 13,14 will enter the ground.

The rotation of the rotatable end 14 of head 13, 14 may be obtained automatically by arranging the spray nozzles 15 at an angle relative to the lengthwise direction of head 13, 14.

The rotation occurs due to a reaction to the spraying by the spray nozzles 15.

Such rotation may possibly also be caused by means of a hydraulic motor controlled from above the ground only the shaft 28 of which is shown in FIG. 3.

The head 13,14 is provided with means to lock the rotatable end 14 relative to body 13 such as a bolt 29 screwed into the body 13 against a part of the end 14 as shown in FIGS. 3*a*, 3*b* and 3*c*.

By adjusting asymmetrically the spray nozzles 15 at a locked end 14, the direction wherealong the head 13,14 enters the ground may be adjusted, in such a way that it is possible to drill at an angle in the ground.

The direction depends on the position of end 14 relative to the head body, which body 13 is fixed relative to pipes 4 and 5. As said pipes 4 and 5 are relatively rigid, they lie stationary relative to said head remainder and consequently the acurate position of end 14 and thus the accurate position of the spray nozzles 15 may be defined.

As the hole is being made, the direction may be changed by adjusting the direction of a spray nozzle 15 or both spray nozzles 15. This may occur after having removed the head 13,14 from the formed hole, but can occur while the head remains in position. The spray nozzles 15 are coupled therefor for example to hydraulic jacks 30 which are mounted in end 14 and can be operated from above the ground as shown in FIG. 3*b*.

The asymmetric spraying may also be obtained with symmetrically-directed spray nozzles 15, by acting on the flow rate from said spray nozzles 15. The end 14 should be locked relative to the remaining portion of head 13,14. The spray nozzles 15 are for example provided with remotely-controlled hydraulic or electromagnetic valves 31 as shown in FIG. 3*c*. In this case also, it is important to know the accurate positon of the spray nozzles 15 in the ground, which is possible because the position of end 14 relative to body 13 can be measured and said head body 13 is stationary relative to pipes 4 and 5.

The head 13,14 is provided with a central bore 19 which communicates with the innermost pipe 4 and which opens at the outermost end of head 13,14, in the spray nozzles 15.

The central bore 19 is surrounded by a ring-like recess 20 which communicates with the space between the outermost pipe 5 and innermost pipe 4, and which opens with a number of sidewise-directed openings 21 on the head outer side.

The openings 21 may be directed radially or be directed at an angle away from the end 14 of head 13,14.

Inside one or a plurality of said openings 21 or inside all the openings 21, direction-adjustable spray nozzles may be mounted.

Such a spray nozzle 22 is shown in FIG. 3 inside one opening 21.

The adjustable mounting of the spray nozzles 22 on head 13,14 is obtained in the same manner as nozzles 15, whereby the ball-shaped end 32 is somewhat pinched in the bearing 33 so that after adjustment it maintains its position. The bearing 33 is screwed into opening 22. Nozzle 22 also can be fixedly mounted on the bearing. Adjustment is possible by replacing nozzle 22 and its bearing by another bearing carrying a nozzle 22 spraying in another direction.

Due to adjusting the direction of said spray nozzle 22 or of all the spray nozzles 22, the direction wherealong the head 13,14 enters the ground may also be adjusted.

Adjusting the direction of spray nozzles 22 can be controlled from above the ground, for example by means of hydraulic or electric jacks 34 controlled from above the ground, as shown in FIG. 3*b*.

Even with stationary spray nozzles 22 or spray nozzles directed symmetrically relative to the axis of head 13,14 the head direction may still be changed by acting on the flow rates of said spray nozzles. As shown in FIG. 3*c* a spray nozzle 22 may for example be provided with a hydraulic or electromagnetic valve 35. The more the spray nozzle does spray, naturally the stronger is the repulsion from the wall of the already-formed hole.

Still another way to direct the head 13,14 lies in spraying when it is desired to change the head through a number of openings irregularly distributed over the circumference, or else in spraying harder through one opening or through a number of openings irregularly distributed over the circumference than through other possible openings which are then completely or partly closed, for example by valves controlled from above the ground.

By selecting those openings which spray or spray harder than the other ones, the direction is determined. That portion 13 of head 13,14 wherein the openings 21 are provided may also be made rotatable relative to the pipes 4 and 5, as shown in FIG. 3*a*. It is thus possible to change the direction of said single opening 21 or said openings 21 irregularly distributed over the circumference, by revolving said head portion e.g. by means of an elastic motor 36 coupled with a gear coupling 37 to the portions 13 and thus spraying asymmetrically and consequently adjusting the direction of head 13,14.

When the spray nozzles 22 are directed away from end 14, there is obtained when spraying through said spray nozzles 22, a thrust in the direction of the head 13,14 entering the ground.

On the end 14 of head 13,14, there may possibly be mounted cutting members, even if this is generally not required.

To make a hole 18 in the ground, the distributing valve 8 is moved to that position whereby the innermost pipe 4 is fed from pump 11 and the space between pipes 4 and 5 is fed from pump 12.

Fluid under a pressure higher than 100 kg/cm$^2$ and with a flow rate larger than 10 liters per minute is thus pumped through the innermost pipe 4 and the spray nozzles 15.

Said fluid under high pressure cuts into the ground, in such a way that the head 13,14 enters the ground under the action of its own weight and/or of the spray nozzles 15 or 22, whereby the head 13,14 and thus the hole direction may be adjusted in one of the above-described ways. As the head 13,14 penetrates deeper into the ground, the twin pipe 4,5 is uncoiled and pushed from reel 1.

As the twin pipe 4,5 is further uncoiled from reel 1 and before same enters the already-made hole, said twin pipe 4,5 which extends in circle shape about the core, is straightened back by means of a device which comprises two pairs of rollers 23, which are mounted on a holder 24 and the axes of which lie in parallel relationship with the axis of reel 1. One pair of rollers 23 lies exactly above the ground surface, axis of reel 1. Due to the relative rigidity of the twin pipe 4,5, same retains the direction thereof as long as the direction of head 13,14 is not being changed in one of the above-described ways. Said direction may be vertical, slanting or even horizontal.

In the latter cases, it may be desired to so arrange the device comprised of the pairs of rollers 23 that said pairs are not located above one another as shown in FIG. 1, but are located symmetrically two by two relative to a plane which makes the required angle with the ground surface, in such a way that they lead the twin pipe 4,5 along the desired direction in the ground or in the already-made hole 18.

The loosened ground may be discharged upwards by means of the carrier fluid which is pumped with a relatively large flow rate and a lower pressure by pump 12 and flows out sidewise from head 13,14 through the openings 21 and/or spray nozzles 22. Said latter fluid prevents the bore hole collapsing and may be used, as already mentioned, for directing the head.

When desired, a seal may be arranged about the mouth of the bore hole on the ground surface, possibly in combination with a tank wherein said latter liquid is collected. Said tank may provide a hydraulic the twin pipe 4,5 in the bore hole 18.

A device as described for example in Belgian Patent no. 902,391 in the name of the Applicant, included herewith by way of reference, may be used here, whereby thus the twin flexible pipe 4,5 forms the bore pipe.

When removing head 13,14 from the ground, nothing has to be uncoupled and it thus possible to go on spraying. This avoids the carrier fluid which is present inside hole 18 about the twin pipe 4,5 and the haed 13,14 and is loaded with ground, flowing due to gravity in the spray nozzles 15 or 22 and obstructing same.

Pulling out the head 13,14 can be performed in a very short time due to the absence of a coupling.

As it is possible to go on spraying when pulling up head 13,14 and as the pulling-up can occur continuously, the wall of hole 18 will not be damaged.

By spraying when pulling up head 13,14 merely, through the openings 21 and particularly through spray nozzles 22 mounted therein, the bore hole may be enlarged thereby.

During the change of direction of head 13,14, by means of that fluid which is sprayed through the openings 21 and/or spray nozzles 15 or 22, the head 13,14 is repelled from the wall of the already-formed bore hole. The accurate position of the head and thus the direction it moves along may thereby be determined in known ways, for example by means of a radio transmitter built therein and a receiver mounted on the ground.

When desired, the fluid with high pressure and small flow rate, and the fluid with lower pressure and larger flow rate can be exchanged for one another, for example when changing the direction of head 13,14.

This may occur in two ways.

It may occur by replacing head 13,14 by another head whereby the ring-like space 20 connects to the spray nozzles 15, while the central bore 19 opens on the sidewise directed openings 21. The fluid under higher pressure is still pumped through the innermost pipe 4 but flows sidewise out of the head 13,14 through the openings 21 or the spray nozzles 22 mounted therein.

A second way to obtain the same result, lies with the same head 13,14, in changing the position of distributing valve 8 in such a way that the pump 11 connects to the space between pipes 4 and 5.

This way allows for example to release the head 13,14 from a dangerous area in the ground. rapidly into the ground.

When it is however desired to drill the head fast into the ground, but to obtain the highest pressure in the space between pipes 4 and 5, for example to prevent under particular conditions, the outermost pipe 5 being crushed, the head 13,14 as shown in the figures is replaced by the head as described for the first operating way and simultaneously the position of distributing valve 8 is changed.

Fluid under high pressure is pumped by pump 11 through the space between pipes 4 and 5, but as said space now communicates with the central bore 19, said high-pressure fluid is now sprayed through the spray nozzles 15.

The above-described device allows a very flexible and fast working.

The fact that the pipes 4 and 5 are comprised of a single piece and thus that no couplings are required provides for a high time gain. As the twin pipe 4,5 is flexible and can be coiled on a reel, relatively little place and mostly little height is required.

The operators of the device do not have to be near the hole mouth on the ground surface any longer.

By adjusting the direction or the flow rate of end 14 relative to body 13, the pattern, the size and the direction of the bore hole 18 may easily be defined. The direction may be set very precisely.

The invention is in no way limited to the above-described embodiments and within the scope of the Patent Application, many changes may be brought to the described embodiments, notably as regards the shape, the composition, the arrangement and the number of the components being used to embody the invention.

It is particularly not always necessary to provide for a destributing valve between the pumps and the two flexible pipes.

The head should not necessarily have a rotatable end.

The complete head may be fixed or rotatable relative to the pipes. Rotation or adjustment of the head with respect to the pipes may occur by hand when the head is out of the ground. After adjustment the head can be locked into its position by means of a bolt 29 screwed through the end piece.

As already stated, a cutting tool may be mounted on the head end, such as a cutter.

The number of spray nozzles on the head end should not necessarily be two. This number may as well be one or more than two.

The spray nozzles should not necessarily be adjustable, even when adjustable spray nozzles provide for wider application possibilities of the device, and Uncoiling the twin pipe does not necessarily have to occur by rotating the reel along the direction as shown in FIG. 1. Said twin pipe may also be uncoiled at the bottom, which is mostly of interest when the pipe should not be driven in the ground vertically, but horizontally or substantially horizontally. The reel may possibly be arranged inside a pit which is excavated beforehand in the ground.

Spraying should not necessarily occur continuously through both pipes. It is possible to spray fluid through one pipe wherewith fluid is sprayed during the directing of the head, only during such directing, or to spray fluid continuously, but to spray during such directing a fluid with a larger flow rate or a higher pressure than otherwise.

The two pumps may be of a different kind. One of them may e.g. be a compressor for pumping gas, the other one a centrifugal or piston pump for pumping liquid.

I claim:

1. A device for making a hole in the ground, which device comprises a head which is comprised of a body and an end, said end bearing at least one spray nozzle which is adjustable in direction and said body being provided with at least one sidewise-issuing opening, a reel;

two concentric inner and outer continuous twistresistant drill pipes for pressurized fluid which are flexible enough to be coiled on and uncoiled from said reel, said inner pipe connecting with said first spray opening in the end and said outer pipe connecting with said sidewise-issuing opening in the body; and two pumps, one of which is connected to the inner pipe and the other of which is connected to the outer pipe.

2. The device of claim 1, which further comprises means to interchange the connection of the pumps to the pipes.

3. The device of claim 1, wherein the end is rotatably mounted on the body.

4. The device of claim 1, wherein in at least one sidewise-issuing opening of the body a spray nozzle is mounted.

5. The device of claim 1, wherein in at least one sidewise-issuing opening of the body a spray nozzle is mounted which is adjustable in direction.

6. The device of claim 1, wherein the body comprises several sidewise-issuing openings and adjustable means for adjusting asymmetrically the spraying through the openings relative to the axis of the body.

* * * * *